US010066407B2

(12) United States Patent
Buzon

(10) Patent No.: US 10,066,407 B2
(45) Date of Patent: Sep. 4, 2018

(54) DEVICE FOR COMPENSATING A SLOPE OF A CONSTRUCTION SURFACE

(71) Applicant: Buzon Pedestal International, Herstal (BE)

(72) Inventor: Claude Buzon, Wavre (BE)

(73) Assignee: Buzon Pedestal International, Herstal (BE)

( * ) Notice: Subject to any disclaimer, the term of this patent is extended or adjusted under 35 U.S.C. 154(b) by 0 days.

(21) Appl. No.: 15/377,269

(22) Filed: Dec. 13, 2016

(65) Prior Publication Data

US 2017/0167150 A1 Jun. 15, 2017

(30) Foreign Application Priority Data

Dec. 14, 2015 (BE) ..... 2015/0271

(51) Int. Cl.
*E04F 15/02* (2006.01)
*E04G 21/18* (2006.01)
(Continued)

(52) U.S. Cl.
CPC ..... *E04G 21/1841* (2013.01); *E04D 11/007* (2013.01); *E04F 15/02183* (2013.01);
(Continued)

(58) Field of Classification Search
CPC ..... E04D 11/007; E04F 15/02482; E04F 15/02452; E04F 15/02464; E04F 15/02476; E01C 5/00
See application file for complete search history.

(56) References Cited

U.S. PATENT DOCUMENTS 5,442,882 A * 8/1995 Repasky ..... E04D 11/007 248/188.4
6,332,292 B1 * 12/2001 Buzon ..... E04D 11/007 248/351
(Continued)

FOREIGN PATENT DOCUMENTS

EP 1027511 8/2000
KR 20130009181 1/2013
(Continued)

*Primary Examiner* — Brian D Mattei
*Assistant Examiner* — Daniel J Kenny
(74) *Attorney, Agent, or Firm* — Jacobson Holman PLLC

(57) ABSTRACT

Set comprising a device for slope compensation of a construction surface and a fixing foot having a gripping member, which device comprises a first and second slope compensation element mounted as to rotate with respect to each other, each element presents a range having a predetermined number of positions where each position corresponds to a slope compensation value, the first and second element comprising a first, respectively a second, series of windows applied each time on each of the elements, the windows of said first and second series of windows being arranged such that for each of the positions, where slope compensation value of the first and second slope compensation element corresponds, at least one of the windows of each of the slope compensation elements being positioned such as to be opposite to each other, the windows when positioned opposite to each other serve to engage the gripping member.

16 Claims, 5 Drawing Sheets

(51) Int. Cl.
*E04F 15/024* (2006.01)
*E04D 11/00* (2006.01)

(52) U.S. Cl.
CPC .. *E04F 15/02464* (2013.01); *E04F 15/02482* (2013.01); *E04F 2015/02061* (2013.01)

(56) References Cited

U.S. PATENT DOCUMENTS

| | | | | |
|---|---|---|---|---|
| 6,520,713 | B2 * | 2/2003 | Sondrup | E02D 29/1409 404/26 |
| 7,744,044 | B2 * | 6/2010 | Gabriel | B65B 67/04 248/101 |
| D679,170 | S * | 4/2013 | Else | D8/349 |
| 2008/0222973 | A1 * | 9/2008 | Lee | E04F 15/02476 52/126.1 |
| 2009/0261115 | A1 * | 10/2009 | Krebs | B65D 25/00 220/694 |
| 2017/0152635 | A1 * | 6/2017 | Tabibnia | F24D 3/127 |

FOREIGN PATENT DOCUMENTS

| | | |
|---|---|---|
| WO | 99/23327 | 5/1999 |
| WO | 2013/011456 | 1/2013 |

* cited by examiner

DEVICE FOR COMPENSATING A SLOPE OF A CONSTRUCTION SURFACE

The present invention relates to a compensation device for compensating a slope of a construction surface, which device is preferably provided for being placed on or under a pedestal enabling to raise the construction surface, which device comprises a first and a second slope compensation element cooperating with each other for compensating the slope, the first and second slope compensation element being mounted in such a manner as to rotate with respect to each other, each element have a range having to a predetermined number of positions successively placed on a part of the circumference of each slope compensation element, each position each time corresponds to a compensation value of the slope of the element to which it is associated.

Such a device is known from the European patent EP 1 027 511 and serves to compensate the slope of the construction surface and thus for enabling for example to place a terrace at a same height on this construction surface. For compensating the slope of the construction surface one starts with determining the slope value of this surface, for example by determining the slope percentage or slope angle. Thereafter one chooses among the number of positions the one that suits to this determined value. Thereafter one lets the first element and second element rotate with respect to each other in order to position them on this determined value. Finally one places the device directly on the surface, or applies on or under a pedestal, if also the height has to be compensated, thereby taking care that it is placed along the orientation of the slope of the surface. In order to maintain the two elements in the chosen position the first compensation element is provided on an internal surface of a notched segment and the second compensation element is provided with a wedge which grips in the notches of the notched segment.

A drawback of the known device is that even with the wedge and the notched segment the established slope can vary between the moment at which it is established and the one at which the device is placed in its final position on the surface. Indeed the wedge and the notched segment do not enable to sufficiently block the elements in the determined position. However they can also not be so as to penalise the rotation of the elements with respect to each other. In case where the position would have changed, it will be necessary to reposition the two elements correctly and this will cause a loss of time and money.

The object of the invention is to realise a device where the probability that the established position changes during the placement phase is reduced while not adversely affecting the ease to position the elements with respect to each other.

To this purpose a device according to the invention is characterised in that the device belongs to a set which also comprises a fixing foot having a gripping member, the first and second slope compensation element comprising a first, respectively a second, series of windows applied each time on each of the elements, the windows of said first and second series of windows being arranged in such a manner that for each of the positions, where slope compensation value of the first and second slope compensation element corresponds, at least one of the windows of each of the slope compensation elements being positioned such as to be opposite to each other, the windows being dimensioned in such a manner that the gripping member can engage into the windows positioned opposite to each other. The presence of a first and second series of windows applied on each of the elements and the fact that at least one of the windows of each of the slope compensation elements is positioned opposite to each other when the slope compensation elements are adjusted at a determined value, will enable the gripping member to engage in those windows for temporarily blocking the discs among each other and thus prevent the rotation of the elements during their placing on the surface. Thus the established value between two elements will remain fixed during the time needed to place the device at its final position. Thereafter the fixation foot can be withdrawn.

A first preferred embodiment of a device according to the invention is characterised that the fixing foot comprises a spatula juxtaposed to the gripping member and dimensioned in such a manner as to receive a part of a user's foot. In such a manner the user can use the fixing foot for maintaining the device at the place where it has to be placed by simply putting a part of his foot on the spatula.

A second preferred embodiment of a device according to the invention is characterised that the spatula is arc shaped and provided with reinforcement ribs on an internal side of the arc shape. This enables a rigid construction resisting to the weight of the foot, while being light.

A third preferred embodiment of a device according to the invention is characterised in that the windows of said first and second series of windows are arranged such that for each of the positions where the slope compensation value of the first and second slope compensation element at least two of the windows of each slope compensation element are positioned in such a manner that they are opposite to each other, the gripping member being configured as a jaw comprising two teeth arranged at a distance from each other in such a manner that each of the teeth can penetrate in one of said two windows positioned opposite to each other. The use of two windows and two teeth renders on the one hand the gripping member more rigid and on the other hand contributes advantageously to maintain the elements in place at the chosen value.

A fourth preferred embodiment of a device according to the invention is characterised in that the windows are oblong shaped. This enables to facilitate the engagement of the teeth into the windows.

A fifth preferred embodiment of a device according to the invention is characterised that the windows of the second series comprise a first, a second and a third sub-set of windows, each subs-set having a predetermined window width, the window width of the third sub-set being larger as the one of the second sub-set of windows which is larger than the one of the first sub-set of windows. This enables to better take into account the different compensation values.

A sixth preferred embodiment of a device according to the invention is characterised it comprises a locking member enabling to lock the first and second slope compensation element in each of the positions. This locking member enables, even after placing, to better maintain the element in the position which corresponds to the chosen value.

A seventh preferred embodiment of a device according to the invention is characterised in that the locking member is formed by a series of first and second openings applied in each of the slope compensation elements and placed along a circle of which the radius is less than the one of the slope compensation element, the second openings being applied in such a manner that for each of said positions at least one second opening of the second series is positioned opposite to a first opening of the first series, the locking member also comprises a key dimensioned for being inserted each time into one of the first and second openings when they are positioned opposite to each other. This enables a reliable and cheap realisation of the locking member.

The invention will now be described in more details by means of the drawings which illustrates a preferred embodiment of a slope compensation device according to the invention for compensating the slope of a construction surface. In the drawings:

FIG. 1 shows a tile placed on a pedestal provided with a compensation device for compensating for the slope of a construction surface;

FIG. 2*a* shows a first face of a first slope compensation element;

FIG. 2*b* shows a cross-sectional view along a line II-II' of the first slope compensation element;

Figure 1:
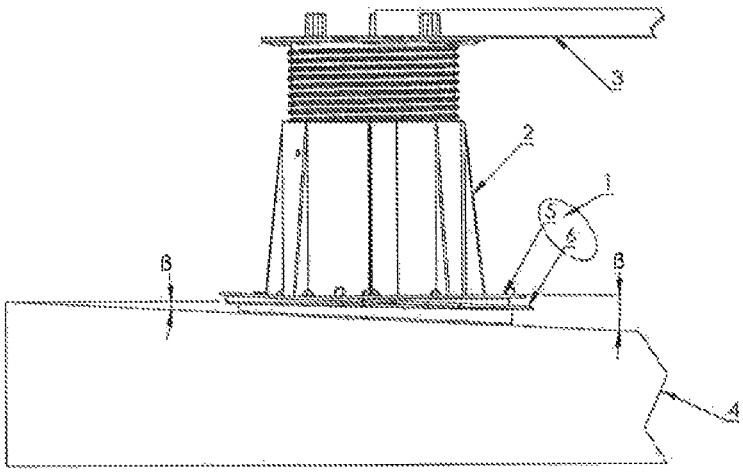

In the drawings a same reference sign has been allotted to a same or analogous element.

FIG. 1 shows in a schematic way a tile 3 placed on a pedestal 2 provided with a compensation device 1 for compensating the slope of a construction surface 4. The pedestal is placed on the construction surface which is inclined under an angle β. This angle has an inclination value which corresponds to a slope percentage of the surface 4, which is sloped. The pedestal self serves to raise the construction surface. The slope compensation device 1 serves to compensate this slope, under an angle β, of the surface, and thus to enable the tile 3 to be placed horizontally on the pedestal provided with device. In the embodiment illustrated in FIG. 1 the device is placed under the pedestal, but it is also possible to place the device on the pedestal or directly on the soil without using a pedestal. The surface slope compensation device comprises a first 5 a second 6 slope compensation element, each having the shape of a disc and cooperating with each other for compensating the slope. The first and second slope compensation element are mounted in such a manner as to be able to rotate with respect to each other.

The FIGS. 2 to 5 show more in detail an embodiment of the first and second slope compensation element. Each element presents a range which comprises a predetermined number of positions ($\alpha_0$, $\alpha_1$, $\alpha_2$, $\alpha_3$, . . . $\alpha_n$) successively placed on a part of the circumference of the slope compensation element. Each position corresponds to a slope compensation value $\alpha_1$ ($0 \leq 1 \leq n$) of the element to which it is associated, this slope being determined with respect to the construction surface 4. The slope compensation value can be expressed in a percentage or a degree. In the example n=5, but it will be clear that this concerns an example and that other values higher or lower than n=5 can also be chosen. Thus in the example of FIG. 1, the device can compensate slope values β situated between 0% and 5%. It is possible to proceed by steps of 1% or by steps of 0.5%. Of course others values for these steps can be used. Preferably each position $\alpha_1$ is provided with a little arrow 7 which indicates the slope direction, which enables then to correctly place the device in the direction of the slope. Those arrows are applied on a peripheral border 11, which itself extends over the whole element.

Figure 2A:
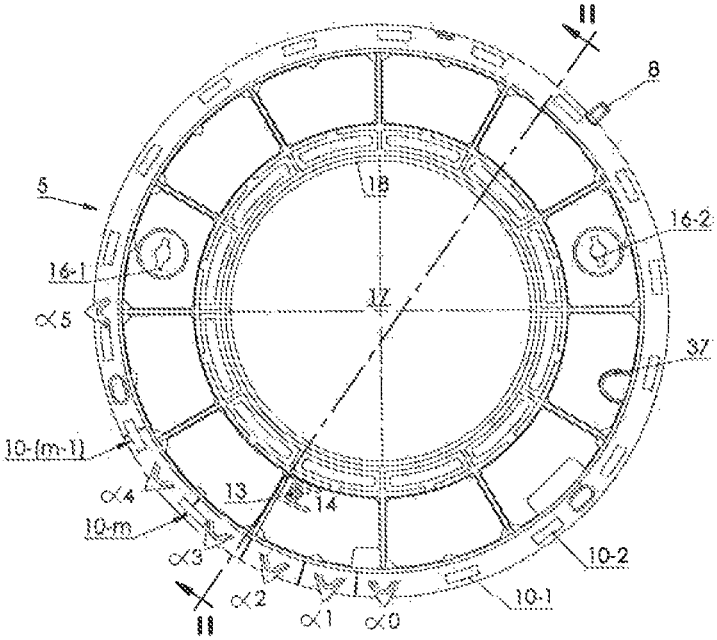
Figure 2B:
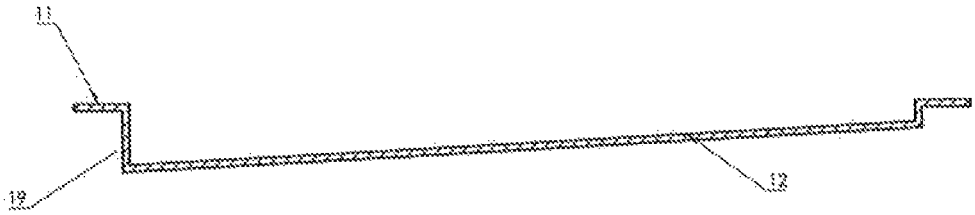

In order to enable this slope compensation, the first compensation element 5 is provided with a sloped profile 12 on its surface area, which sloped profile extends diagonally across the element as illustrated in FIG. 2*b*. This profile is preferably formed by a stair 19 of a staircase which extends in an inclined manner over the surface area of the disc and offset of the peripheral border 11. The height of this stair varies preferably in a continuous manner along the diameter of the element. Thus in the orientation of the element shown in the FIGS. 2*a, b* and 3 the stair raises in height in a direction from the right to the left.

The first element 5 comprises a first series of windows 10-*i* ($1 \leq i \leq m$) crossing this element. In the illustrated example m=16, but it will be clear that the invention is not limited to this number and that other values for m are also possible. The windows are preferably applied on this first element along the external peripheral border 11 of the first element in order to facilitate the grip of a fixing foot, as will be described hereunder. The windows preferably have an oblong shape, but other shapes such as oval or trapezoidal can also be considered. The different windows are preferably applied in an equidistant manner of each other.

The first element 5 preferably also comprises a first opening 13 and a wedge 14 of which the function will be described hereunder.

Figure 3:
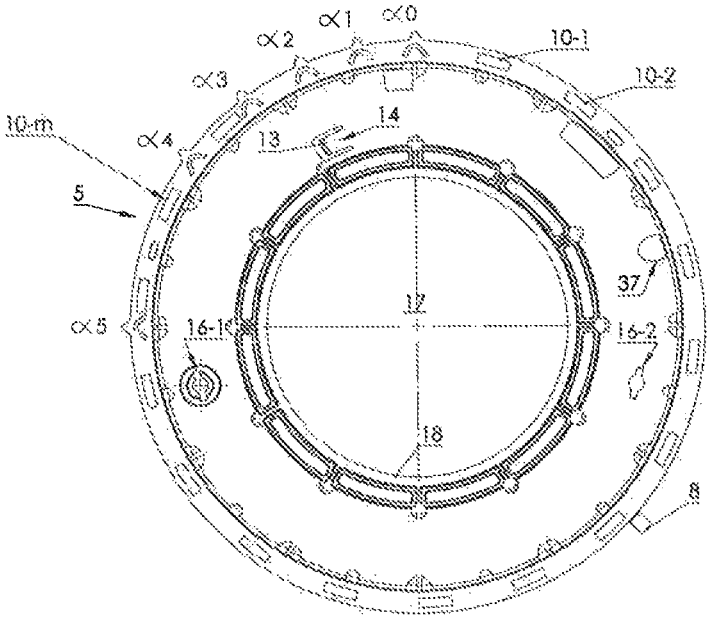
FIG. 3 shows a second face, opposite to the first face, of a first slope compensation element.

A series of first openings 16-1 and 16-2 each time placed on a raised surface 15 is also preferably foreseen on this first element. This series of first openings belongs to a locking member, described in more details hereunder. This raised surface is for example realised by a level difference realised on the first face in the material of which the first element is realised, as illustrated in FIG. 3. Each of these first openings serves to receive a locking member as will be described in more details hereunder. The first openings are preferably oblong shaped and provided with a circular part in the middle.

In order to facilitate the rotation of the first element with respect to the second, first protuberances 8 are preferably placed on the peripheral border 11. These first protuberances are arranged in such a manner as not to interfere with the first windows. The first protuberances form a grip for starting the rotation of the element.

The first element 5 also comprises a third opening 17 applied at the centre and provided with a circular border 18 provided for engaging with the second element 6.

Figure 4:
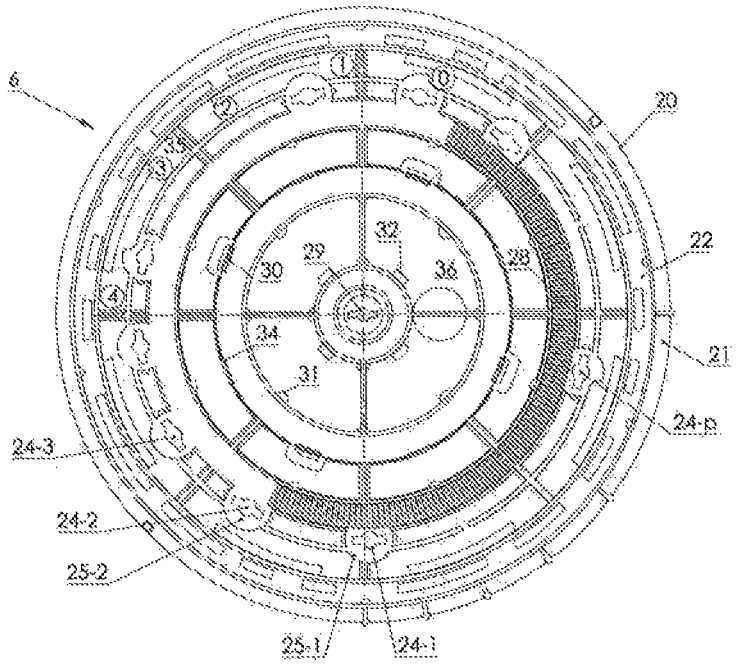
FIG. 4 shows a first face of a second slope compensation element.

The second slope compensation element 6, of which the first face is shown in FIG. 4, comprises analogously to the first element, a sloped profile which extends diagonally across the element. The peripheral border 20 of the second element preferably comprises a staircase shape formed by a stair 22 which extends from an intermediate stair 21, which itself extends from the peripheral border 20 of the second element 6. The sloped profile preferably extends over the stair 22.

Figure 5:
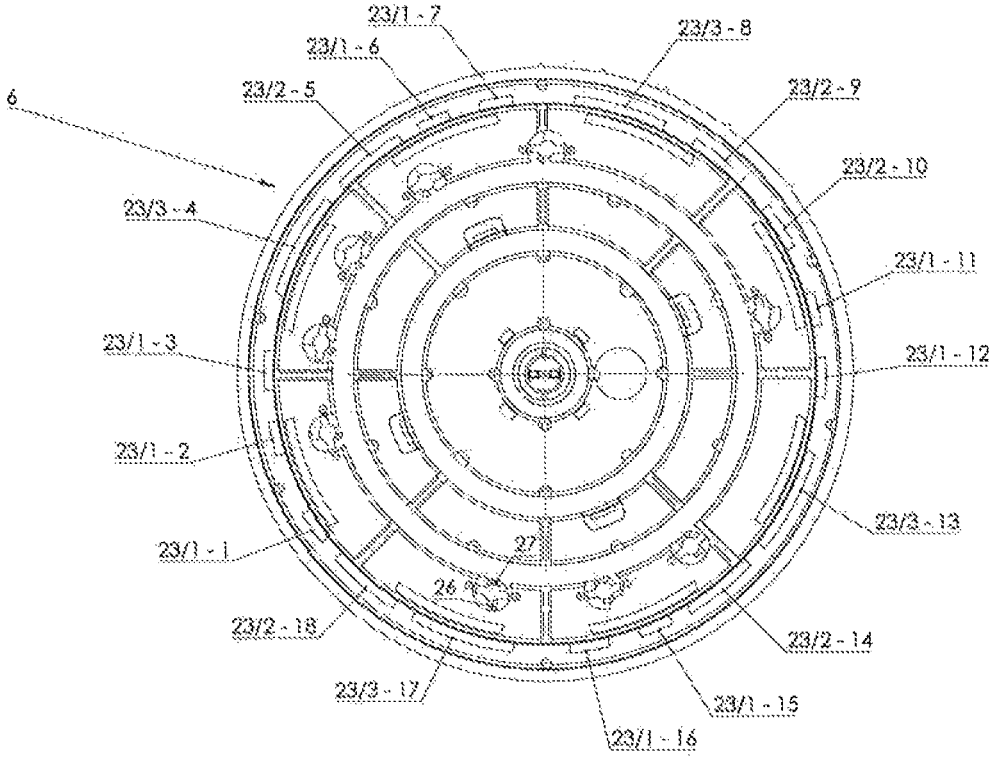
FIG. 5 shows a second face, opposite to the first face, of a second slope compensation element.

The second element 6 comprises a second series of windows 23-*j* ($1 \leq j \leq k$) as illustrated in FIG. 5. In the shown example k=18, but it will be clear that the invention is not limited to this number and that other values for k are also possible. The windows are preferably arranged on the stair 22 and over the whole circumference of the second element in order to facilitate the grip of a fixing foot, as will be described hereunder. The windows are preferably oblong shaped, but other shapes such as oval or trapezoidal could also be envisaged. Of course the geometry of the second series of windows has to correspond with the one of the first series of windows in order to enable the fixing foot to be engaged as will be described hereunder. The windows 23 of the second series comprise a first 23/1, a second 23/2 and a third 23/3 window sub-set, each sub-set having a predetermined window width, the window width of the third sub-set being larger than the one of the second sub-set which themselves are larger than the one of the first sub-set of windows.

The windows of the first 10 and second 23 series of windows are arranged in such a manner that for each of the positions where the slope compensation value ($\alpha$) of the first and second slope compensation element correspond, at least one of the windows 10-*i* of the first slope compensation element and at least one of the windows 23-*j* of the second slope compensation element are positioned opposite to each other. Preferably however the windows of the first and second series of windows are arranged in such a manner that for each of the positions where the slope compensation value of the first and second slope compensation element correspond at least two of the windows of each of the slope compensation elements are positioned opposite to each other. This latter embodiment offers a better anchoring of the gripping member as will be described hereunder.

A series of second openings 24-*p* ($1 \leq p \leq w$), each time applied in a cavity 25-*p*, is also preferably foreseen on this second slope compensation element. These second openings cooperate with the first openings 16 present on the first element and belong to the locking member. For this reason the second openings have a similar profile as the one of the first openings. The cavities 25, which extend over the second face of the second element, comprise an internal shape provided with two second protuberances 26 and 27 applied diagonally with respect to the centre of the cavity, as illustrated in FIG. 5. These protuberances, which form a retaining element, are arranged along the oblong shape of the opening. The protuberances extend each time over halve of the length of the opening. In the illustrated example w=9, but it will be clear that the invention is not limited to this number.

A notched segment 28 is placed on the first face of the second element and cooperates with a wedge 14 of the first element in order to enable a step by step rotation of the first and second element with respect to each other as well as a weak retention of the second element with respect to the first.

The second element comprises in its central part 33 a first series of holes 31 and a second series of holes 32 for enabling a draining of rain water which would fall on the compensation device. A central hole 29 is also foreseen. The first and second series of holes are in the bottom of a basin 36 applied in the centre of the second element. The basin enables to collect rain water before its evacuation by said holes 31 and 32.

Winglets 30 are applied along the peripheral of a ring 34 placed at approximately half of the radius of the second element. Each of the winglets is provided with a small notch placed at their extremity and serving for gripping on the circular border 18 of the first element, thus enabling to connect together the first and second element while making the rotation of both elements with respect to each other possible.

The first face of the second slope compensation element 6 preferably also has the values $\alpha$ for slope compensation. Those values, indicated by reference 35, are placed on about two third of the radius of the second element at a height which corresponds to the one at which the first opening 37 of the first slope compensation element 5 is applied. In such a manner the user, who places the device can look through the first opening 37 if the value which is indicated on the second element corresponds to the value $\alpha$ which he has been chosen.

Figure 6:
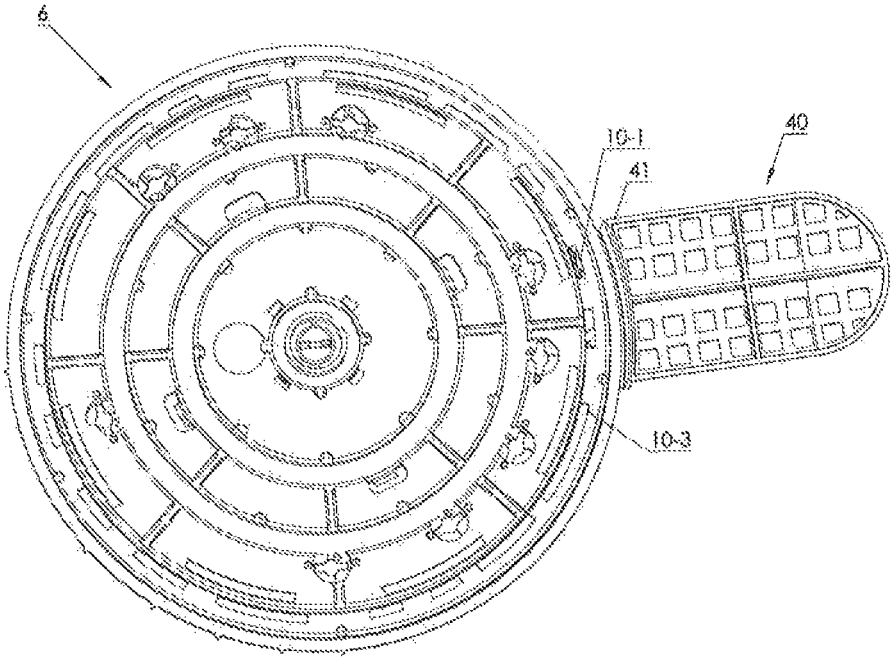
FIG. 6 shows the set of the device for compensating the slope of a construction surface and the fixing foot.
Figure 7:
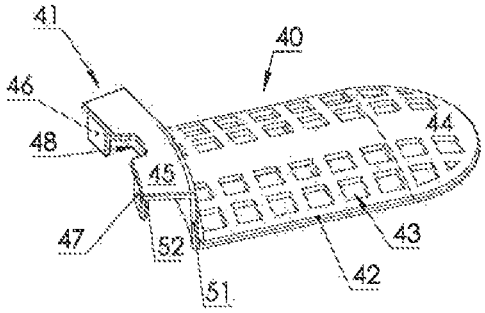
FIG. 7 shows an upper side view of the fixing foot.

FIG. 6 shows the set comprising the device 1 for compensating the slope of a construction surface and the fixing foot 40. The fixing foot comprises a gripping member 41 provided to engage in at least one of the windows 10 of the first element and at least one the windows 23 of the second element. As shown in FIG. 7 the fixing foot comprises a spatula 42 juxtaposed to the gripping member 41 and dimensioned in such a manner as to receive a part of a user's foot. Preferably the fixing foot has a length of 10 cm. Of course it concerns here a preferred embodiment and other dimensions are also possible.

Figure 8:
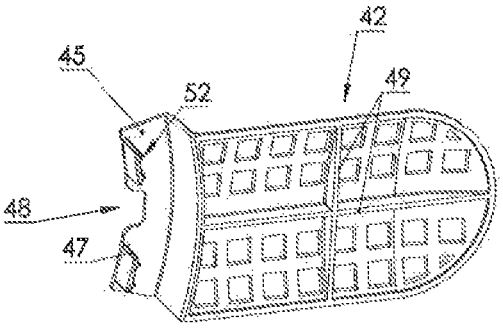
FIG. 8 shows an under side view of the fixing foot.

The spatula 42 is preferably arc shaped, as illustrated in FIG. 8, and provided with reinforcement ribs 49 on an internal side of the arc shape. As indicated by their name those ribs serve to reinforce the structure of the spatula and thus to better support the weight of the foot which would be placed on the spatula. Those reinforcement ribs are preferably realised by a horizontal branch and a vertical branch which cross each other at the centre of the spatula. In such a manner a good repartition is obtained as well in the horizontal as in the vertical direction. The spatula is preferably provided with a series of perforations 43, which on the one hand enable to lighten the structure while rendering it more rigid and on the other hand to save material of which the spatula is made. This series of perforations extend on both sides of a central nerf 44 under which the vertical branch of the reinforcement rib 49 extend.

The gripping member 41 is preferably configured as a jaw 45 comprising two teeth 46 and 47 applied at a distance from each other in such a manner that each of the teeth can penetrate in one of the two successive windows when they are positioned opposite to each other. However, it is also possible to consider an embodiment where the jaw only comprises one tooth. The embodiment with two teeth offers the advantage that two teeth each time grip in each of the two windows which are opposite to each other, thereby improving the blocking of the two elements at their chosen slope value $\alpha$. The distance at which the teeth are placed from each other creates a space 48 between the teeth which enable to better visualise the windows and thus facilitate the placing of the teeth into the windows. Preferably the teeth 47 and 48 are provided with small protuberances 52 placed at their internal face situated at the inside of the jaw 45. Those small protuberances serve to limit the play between the teeth when introduced in the windows.

Preferably the jaw 45 is raised with respect to the surface in which the spatula 42 is situated. In such a manner enough space is left over to the teeth 46 and 47 to extend and the raising wall 51 of the jaw forms a stop for the foot which will be put on the spatula 42. The teeth are arranged according to an arc in order to mate the circular shape of the elements in which the windows are applied.

Figure 9:
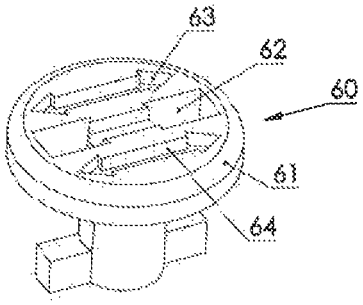
FIG. 9 shows the key of the locking member.

The locking member also comprises a key 60 enabling to lock the first and second slope compensation element in each of the slope compensating positions. A preferred embodiment for this key 60 is shown in FIG. 9. The key is dimensioned for being each time inserted into one of the first and second openings of the first respectively the second elements when they are positioned opposite to each other at one of the slope angles. The key has a T shape placed on a pastille 61. The head of the T shape is situated opposed the pastille and separated by the vertical branch of the T shape. This vertical branch is preferably cylindrically shaped and the head is rectilinear shaped. The upper face of the pastille comprises a central channel 62 dimensioned so that a screwdriver end can be inserted therein. Preferably two arrows 63 and 64 are applied on each side of the channel 62 for indicating that the key has to be rotated.

When placing the compensation device according to the invention, a user will first determine the slope value β and the direction of the inclination of the slope on which the device has to be placed. Thereafter he will take the first 5 and second slope compensation element and will rotate the one element with respect to the other in order to position both elements at a value $\alpha_i$ which corresponds to the determined slope value β. During the latter operation the user will look at the a values indicated either on the border of the elements, or those which are visible through the first opening 13, or to both value indications. The wedge 14 will, during the rotation of both elements, be displaced over the notched segment 28 thus enabling a step by step rotation of the first element with respect to the second. In such a manner a precise adjustment of a value is made possible.

The rotation of the slope compensation elements 5 and 6 will cause that the windows of said first 10 and second 23 series of windows will follow this rotational movement as they belong to those elements. In such a manner when the elements will be adjusted at their chosen value α, at least one window 10-*i* of the first series 10 and at least one window 23-*j* of the second series of windows will be opposite to each other. In the embodiment shown in the FIGS. 2 to 5 there are two windows of each element which are opposite to each other.

As now at least one window 10-*i* of the first series 10 and at least one window 23-*j* of the second series 23 of windows are opposite to each other, it will become possible to engage the gripping member 41 of the fixing foot into those windows which are opposite to each other. The user will thus engage the gripping member into those windows which will have as a consequence to block the rotation of the elements among them. Indeed, the gripping member while crossing as well the window 10-*i* of the first series 10 as the window 23-*j* of the second series 23 of windows will prevent the rotation of the elements among each other. In such a manner the two elements remain blocked on the value α at which they have been positioned on beforehand. The presence of the spatula 42 will enable the user to put his foot on this spatula and thus to maintain temporarily the elements 5 and 6 in place at the location at which they have to be placed. The fact that the user can maintain the elements in place by means of his foot, will leave free hands for placing, if necessary, the pedestal 2 and the tiles 3.

When the gripping member 41 comprises two teeth, as illustrated in the example of FIG. 7, each of the teeth will penetrate in one of the windows which will enable to even more block the rotation of the two elements 5 and 6. The presence of two teeth limits in such a manner considerably the rotation of the gripping member with respect to the elements 5 and 6.

In order to take care that the positioning at the value α remains also fixed after the elements 5 and 6 have been placed at the location where they have to be placed, the locking member will be activated. To this purpose the user will put the key 60 in this opening of the series of first openings 16-1 and 16-2 which are opposite an opening of the series of second openings 24-*p*. Indeed the rotation of the elements 5 and 6 in order to position them on the value α, will also have had as a consequence that one of the openings 16-1 and 16-2 of the first element will be opposite to one of the openings 24-*p* of the second element. This will thus enable to have the head of the vertical branch of the T shape of the key to penetrate into the opening 16 which will be faced to one of the openings 24-*p*. The key will, during this operation, be aligned in such a manner that the head extends along the same direction as the oblong shape of the openings. When the head and the vertical branch of the key will have crossed the two openings 16 and 24, the pastille 61 will rest on the raised surface 15. By means of a screwdriver, which he will put in the central channel 62, the user will let the key rotate in order that the head of the key can be blocked on the protuberances 26 and 26 situated inside the cavity 25. By this blocking on the protuberances the locking member will lock the key and the two elements 5 and 6 with each other thereby preventing a later rotation of those elements.

The invention claimed is:

1. A compensation device for compensating a slope of a construction surface, which device is provided for being placed on or under a pedestal enabling to raise the construction surface, the device comprising:

first and second slope compensation elements cooperating with each other for compensating the slope, the first and second slope compensation elements being mounted in such a manner as to rotate with respect to each other, each element having a range of position indicators placed on a part of the circumference of each slope compensation element, each position indicator corresponding to a compensation value of the slope of the element to which it is associated, and a fixing foot having a gripping member, the first slope compensation element having a first series of windows, and the second slope compensation element having a second series of windows, the windows of said first and second series of windows being arranged in such a manner that for each of the position indicators where slope compensation values of the first and second slope compensation elements correspond, at least one of the windows of each of the slope compensation elements are positioned such as to be opposite to each other, the windows being dimensioned in such a manner that the gripping member can engage into the windows positioned opposite to each other.

2. The device according to claim 1, characterised in that the windows are arranged along the circumference of the slope compensation elements.

3. The device according to claim 1, characterised in that the fixing foot comprises a spatula juxtaposed to the gripping member and dimensioned in such a manner as to receive a part of a user's foot.

4. The device according to claim 3, characterised in that the spatula is arc shaped and provided with reinforcement ribs on an internal side of the are shape.

5. The device according to claim 3, characterised in that the spatula is provided with a series of perforations.

6. The device according to claim 5, characterised in that the windows of said first and second series of windows are arranged such that for each of the positions where the slope compensation value of the first and second slope compensation element at least two of the windows of each slope compensation element are positioned in such a manner that they are opposite to each other, the gripping member being configured as a jaw comprising two teeth arranged at a distance from each other in such a manner that each of the teeth can penetrate in one of said two windows positioned opposite to each other.

7. The device as claimed in claim 6, characterised in that the jaw is raised with respect to a surface in which the spatula is situated.

8. The device according to claim 6, characterised in that a cut-out in the jaw is provided in a space between the teeth.

9. The device according to claim 1, characterised in that the windows are oblong shaped.

10. The device according to claim 9, characterised in that the windows of the first series have a substantially equal dimension.

11. The device according to claim 9, characterised in that the windows of the second series comprise a first, a second and a third sub-set of windows, each sub-set having a predetermined window width, the window width of the third sub-set being larger than the one of the second sub-set of windows which is larger than the one of the first sub-set of windows.

12. The device according to claim 1, characterised in that the border of the second element comprises a staircase shape, the first series of windows being applied on an intermediate staircase stair.

13. The device according to claim 1, characterised in that it comprises a locking member enabling to lock the first and second slope compensation element in each of the positions.

14. The device according to claim 13, characterised in that the locking member is formed by a series of first and second openings applied in each of the slope compensation elements and placed along a circle of which the radius is less than the one of the slope compensation element, the second openings being applied in such a manner that for each of said positions at least one second opening of the second series is positioned opposite to a first opening of the first series, the locking member also comprises a key dimensioned for being inserted each time into one of the first and second openings when they are positioned opposite to each other.

15. The device according to claim 14, characterised in that each second opening is oblong shaped provided with a circular part at the centre, said key having a T shape placed on pellet.

16. The device according to claim 15, characterised in that the second opening is provided with a retention element for retaining a head of the T shaped key.

* * * * *